US008944760B2

(12) United States Patent
Chiu et al.

(10) Patent No.: US 8,944,760 B2
(45) Date of Patent: Feb. 3, 2015

(54) FAN FRAME

(75) Inventors: Po-Wen Chiu, New Taipei (TW); Wen-Hu Lu, Shenzhen (CN); Zhan-Yang Li, Shenzhen (CN)

(73) Assignee: ScienBiziP Consulting (Shenzhen) Co., Ltd., Guangdong (CN)

( * ) Notice: Subject to any disclaimer, the term of this patent is extended or adjusted under 35 U.S.C. 154(b) by 629 days.

(21) Appl. No.: 13/232,142

(22) Filed: Sep. 14, 2011

(65) Prior Publication Data

US 2012/0230819 A1 Sep. 13, 2012

(30) Foreign Application Priority Data

Mar. 7, 2011 (CN) ..... 201110053496.5

(51) Int. Cl.
*F04D 29/64* (2006.01)
*F04D 25/06* (2006.01)

(52) U.S. Cl.
CPC ..... *F04D 25/0613* (2013.01); *F04D 29/646* (2013.01); *Y10S 411/913* (2013.01)
USPC ... 415/214.1; 415/220; 361/695; 361/679.48; 361/679.58; 411/349; 411/549; 411/553; 411/508; 411/913

(58) Field of Classification Search
CPC ... F04D 19/002; F04D 29/522; F04D 29/644; F04D 29/646; F05B 2230/60; F05B 2230/70
USPC ..... 415/119, 213.1, 214.1, 220; 361/695, 361/679.48, 679.49, 679.57, 679.58; 411/349, 549, 553, 508, 913
See application file for complete search history.

(56) References Cited

U.S. PATENT DOCUMENTS

| | | | | |
|---|---|---|---|---|
| 8,120,906 | B2 * | 2/2012 | Li | 361/679.58 |
| 2004/0257767 | A1 * | 12/2004 | Wang | 361/695 |
| 2006/0239796 | A1 * | 10/2006 | Franks | 411/455 |
| 2009/0191025 | A1 * | 7/2009 | Jackson, Jr. | 411/510 |
| 2011/0076932 | A1 * | 3/2011 | Li | 454/184 |
| 2011/0158791 | A1 * | 6/2011 | Li | 415/119 |
| 2012/0148397 | A1 * | 6/2012 | Tsai et al. | 415/213.1 |

* cited by examiner

*Primary Examiner* — Christopher Verdier
(74) *Attorney, Agent, or Firm* — Novak Druce Connolly Bove + Quigg LLP

(57) ABSTRACT

A fan frame includes a blade holder, a pair of ventilation plates, and at least one side plate. The pair of ventilation plates is attached to opposite sides of the blade holder along a first direction and includes a pair of securing blocks. The at least one side plate is attached to the blade holder along a second direction substantially perpendicular to the first direction and located between the pair of ventilation plates. The pair of mounting slots is defined in the at least one side plate and engaged with the pair of securing blocks, thereby securing the pair of ventilation plates and the at least one side plate to the blade holder.

20 Claims, 4 Drawing Sheets

FAN FRAME

BACKGROUND

1. Technical Field

The present disclosure relates to fan frames.

2. Description of Related Art

Fan modules play an important role in computing devices. A typical fan module includes a fan frame and a blade accommodated in the fan frame. The fan frame includes a blade holder and a pair of ventilation plates attached to opposite sides of the blade along an axial direction. The blade is accommodated in the blade holder and generates airflow through the pair of ventilation plates. However, the pair of ventilation plates is attached to the blade holder by screws, which is inconvenient to assemble or disassemble the fan frame.

Therefore, there is room for improvement within the art.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
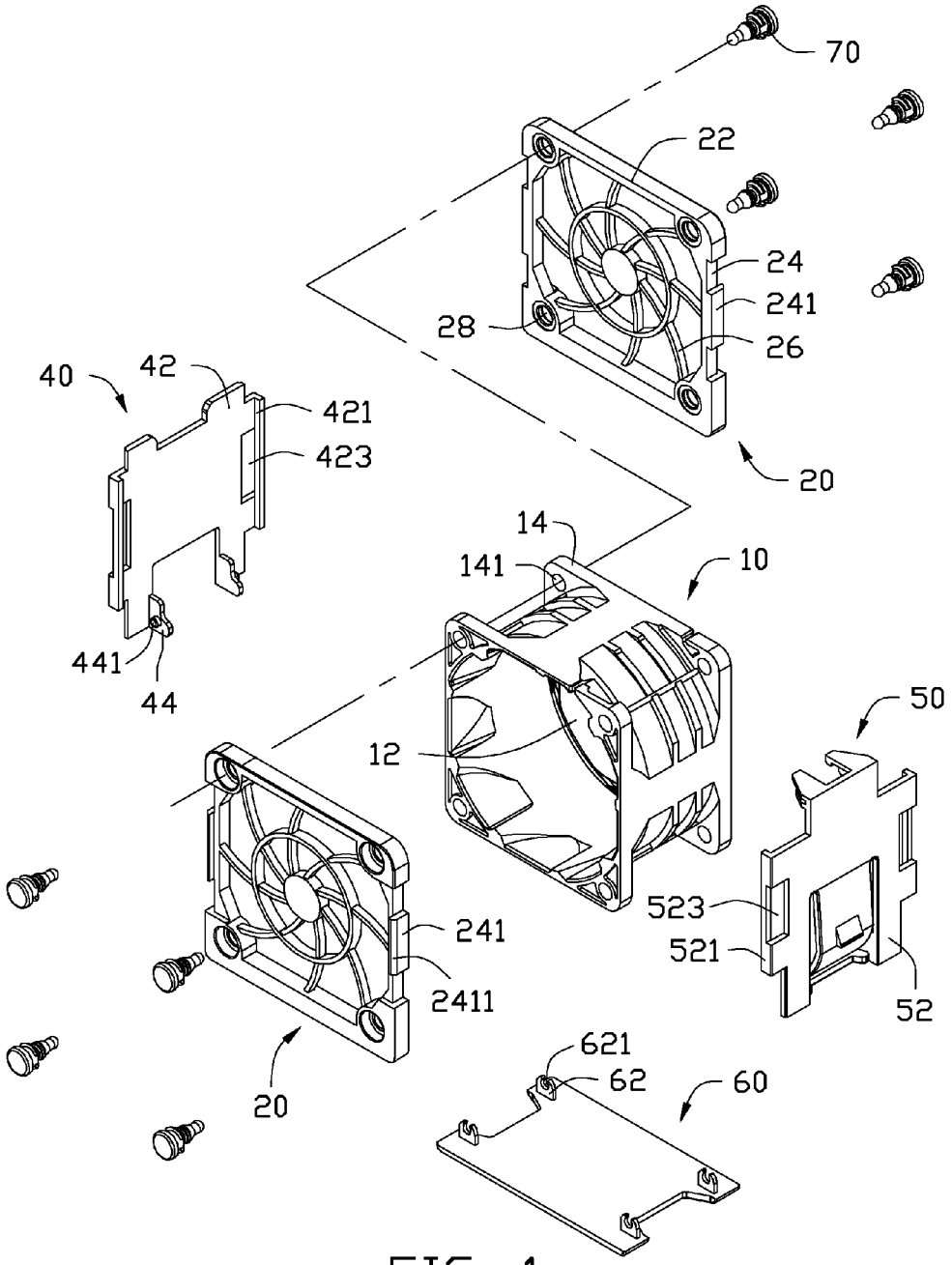
FIG. 1 is an exploded view of a fan module according to an embodiment.
Figure 2:
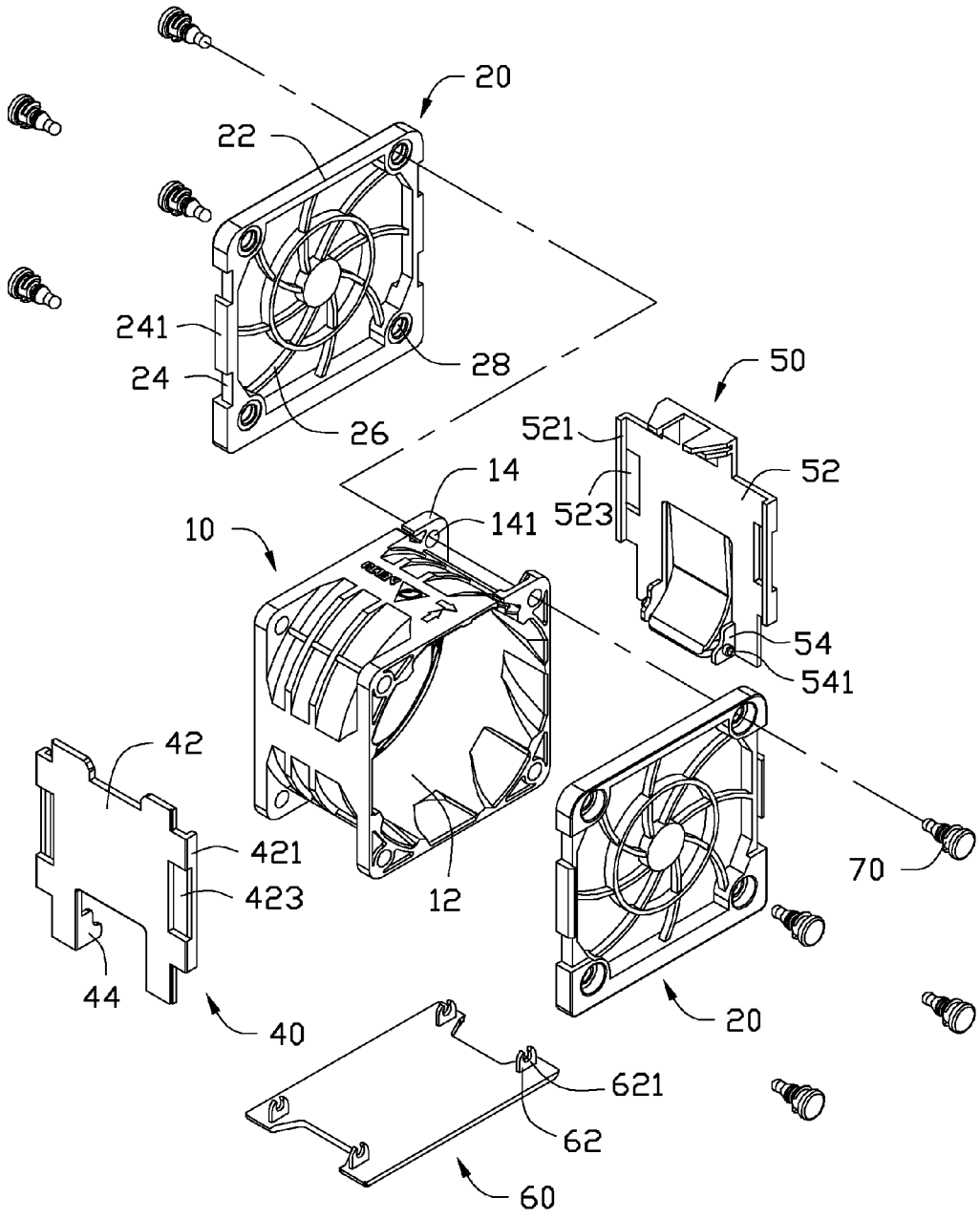
FIG. 2 is another exploded view of the fan module of FIG. 1 viewed from another aspect.

Referring to FIGS. 1 and 2, an embodiment of a fan frame includes a blade holder 10, a pair of ventilation plates 20, a first side plate 40, a second side plate 50, a cover plate 60, and a plurality of securing members 70.

The blade holder 10 includes an accommodating portion 12 accommodating a fan blade and a pair of planar frames 14 disposed at opposite sides of the accommodating portion 12. Each of the pair of planar frames 14 includes four corners. A mounting hole 141 is defined in each corner of the pair of planar frames 14.

Each of the pair of ventilation plates 20 includes a rectangular frame 22 and a plurality of ribs 26 enclosed in and connected to the rectangular frame 22. The rectangular frame 22 includes a pair of vertical beams (not labeled) on opposite sides of each other. A pair of notches 24 is defined in each of the pair of vertical beams. Each of the ventilation plates 20 further includes a securing block 241 located in each of the pair of notches 24. A vertical side of the securing block 241 protrudes from the vertical beam along an axial direction. The securing block 241 includes a slanted guiding edge 2411 at the vertical side of the securing block 241. A securing hole 28 is defined in each of the four corners of the rectangular frame 22.

The first side plate 40 includes a first main plate 42 and a pair of first side flanges 421 extending substantially perpendicularly from opposite sides of the first main plate 42. A pair of first mounting slots 423 is defined in the first side plate 40 corresponding to the securing block 241. Each first mounting slot 423 includes a wider portion defined in the first main plate 42 and a narrower portion defined in the corresponding first side flange 421. A pair of first tabs 44 extends substantially perpendicularly from a lower portion of the first main plate 42 along a first horizontal direction. A first mounting post 441 protrudes from each of the pair of first tabs 44 along a second horizontal direction substantially perpendicular to the first horizontal direction. The first side plate 40 has a symmetrical shape.

The second side plate 50 is similar to the first side plate 40. The second side plate 50 includes a second main plate 52 and a pair of second side flanges 521 extending substantially perpendicularly from opposite sides of the second main plate 52. A pair of second mounting slots 523 is defined in the first side plate 50 corresponding to the securing block 241. A pair of second tabs 54 extends substantially perpendicularly from a lower portion of the second main plate 52. A second mounting post 541 protrudes substantially perpendicularly from each of the pair of second tabs 54.

The cover plate 60 includes a base plate (not labeled) and four protruding pieces 62 protruding substantially perpendicularly from four corners of the base plate. A gap 621 is defined in a top portion of each of the protruding pieces 62. The gap 621 can be arc-shaped.

Figure 3:
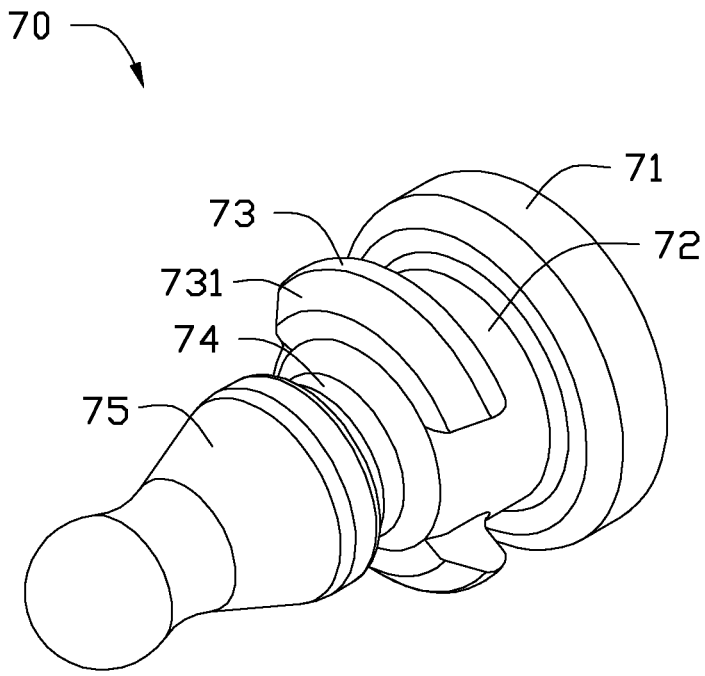
FIG. 3 is an enlarged view of a securing member of FIG. 1.

Referring to FIG. 3, each of the securing members 70 includes a head 71 and an axial post (not labeled) extending from the head 71. The axial post includes a first concave portion 72, a pair of resisting protrusions 73, a second concave portion 74, and a mounting end 75. The first concave portion 72 is located between the head 71 and the pair of resisting protrusions 73. The second concave portion 74 is located between the pair of resisting protrusions 73 and the mounting end 75. The mounting end 75 can have a conical shape. A diameter of the first concave portion 72 is less than that of the head 71. A diameter of the second concave portion 74 is less than a maximum diameter of the mounting end 75. Each of the pair of resisting protrusions 70 has a slanted guiding surface 731.

Figure 4:
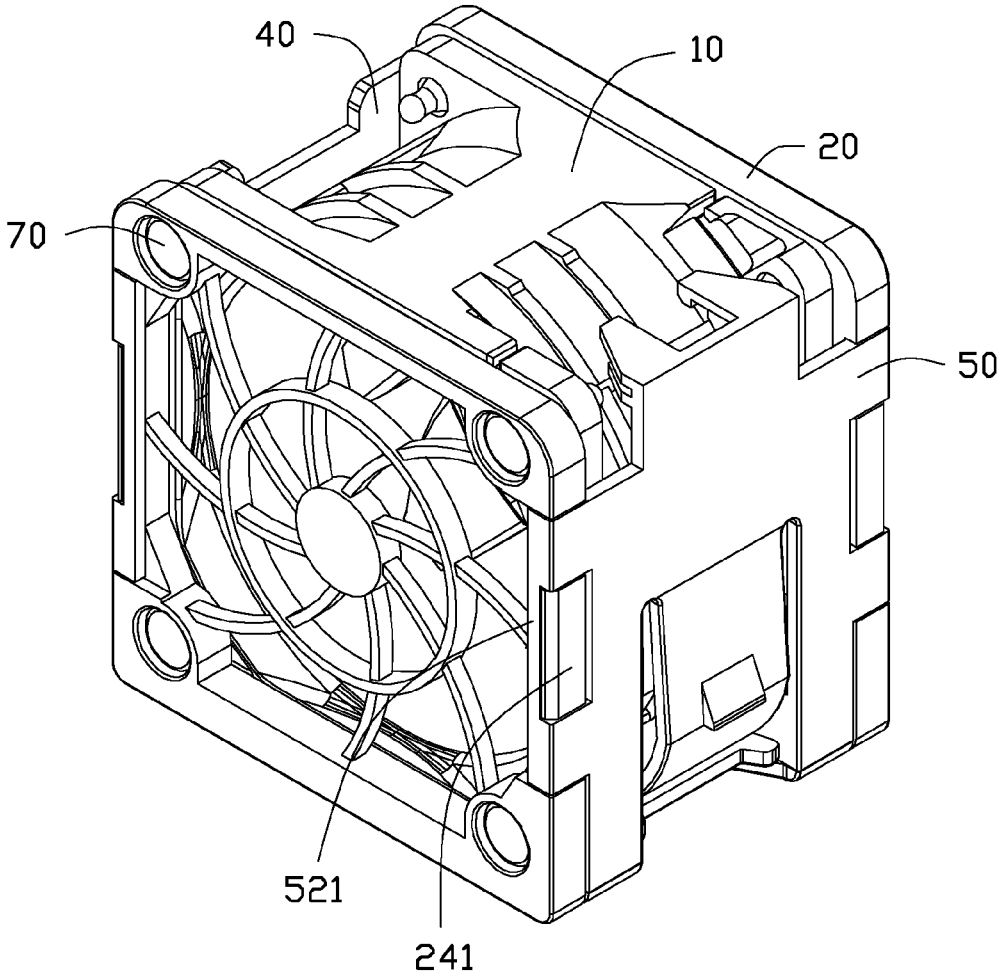
FIG. 4 is an assembled view of the fan module of FIG. 1.

Referring to FIG. 4, in assembly, each of the plurality of securing members 70 is aligned with the securing hole 28. An inner edge of the securing hole 28 resists the slanted guiding surface 731. The pair of resisting protrusions 73 extends through the securing hole 28. The first concave portion 72 is engaged in the securing hole 28. The pair of resisting protrusions 73 and the head 71 are located at opposite sides of the securing hole 28. The mounting end 75 is aligned with the mounting hole 141 and is engaged in the mounting hole 141. The pair of ventilation plates 20 is attached to the blade holder 10 by the plurality of securing members 70. The pair of first mounting slots 423 is aligned with the securing blocks 241 at a first side of the blade holder 10. The pair of second mounting slots 523 is aligned with the securing blocks 241 at a second side of the blade holder 10, which is opposite to the first side. The first side plate 40 and the second side plate 50 are disposed at the first side and the second side of the blade holder 10, respectively. The pair of first side flanges 421 resists the slanted guiding edges 2411 at the first side until the securing blocks 241 at the first side are engaged in the pair of first mounting slots 423. The pair of second side flanges 521 resists the slanted guiding edges 2411 at the second side until the securing blocks 241 at the second side are engaged in the pair of second mounting slots 523. The securing blocks 241 resists inner edges of the pair of first side flanges 421 and the pair of second side flanges 521. Thus, the first side plate 40 and the second side plate 50 are secured to the pair of ventilation plates 20 and located at opposite sides of the blade holder 10. The gaps 621 are aligned with the first mounting posts 441 and the second mounting posts 541. The cover plate 60 moves to the first mounting posts 441 and the second mounting posts 541. The first mounting posts 441 and the second mounting posts 541 are engaged in the gaps 621. The cover plate 60 is attached to a base of the blade holder 10.

While the present disclosure has been illustrated in detail in one or more embodiments, it is not intended to restrict or in any way limit the scope of the appended claims to such detail. Additional advantages and modifications within the spirit and scope of the present disclosure will readily appear to those skilled in the art, and the present disclosure is not to be limited to the specific details and illustrative examples shown and described.

What is claimed is:

1. A fan frame comprising:

a blade holder having opposite sides;

a pair of ventilation plates respectively attached to the opposite sides of the blade holder along a first direction, and comprising a pair of securing blocks;

at least one side plate attached to the blade holder along a second direction substantially perpendicular to the first direction, and located between the pair of ventilation plates, the at least one side plate having a mounting post;

a pair of mounting slots defined in the at least one side plate and engaged with the pair of securing blocks, the pair of mounting slots securing the pair of ventilation plates and the at least one side plate to the blade holder;

a cover plate attached to the blade holder along a third direction different from both the first direction and the second direction, wherein the cover plate is engaged with the mounting post, thereby securing the cover plate to the blade holder.

2. The fan frame of claim 1, further comprising a plurality of securing members, wherein the blade holder comprises a pair of planar frames, one of the pair of planar frames is at an air outlet of the blade holder, and another one of the pair of planar frames is at an air inlet of the blade holder, at least one mounting hole is defined in each of the pair of planar frames, at least one securing hole is defined in each of the pair of ventilation plates, and at least one of the securing members extends through the at least one securing hole and the at least one mounting hole to attach each of the pair of ventilation plates to the blade holder.

3. The fan frame of claim 2, wherein each of the securing members comprises a head, a first concave portion, a pair of resisting protrusions, a second concave portion, and a mounting end, the first concave portion is located between the head and the pair of resisting protrusions, the second concave portion is located between the pair of resisting protrusions and the mounting end; the first concave portion is engaged in the at least one securing hole, and the mounting end is engaged in the at least one mounting hole.

4. The fan module of claim 3, wherein each of the pair of resisting protrusions comprises a slanted guiding surface.

5. The fan module of claim 3, wherein a diameter of the first concave portion is less than that of the head, a diameter of the second concave portion is less than a maximum diameter of the mounting end, and the mounting end has a conical shape.

6. The fan module of claim 1, wherein each of the pair of ventilation plates comprises a vertical beam, a pair of notches is defined in the vertical beam, and each of the pair of securing blocks is located in a corresponding notch.

7. The fan module of claim 1, wherein the third direction is substantially perpendicular to both the first direction and the second direction.

8. The fan module of claim 7, wherein the at least one side plate comprises a main plate substantially perpendicular to the pair of ventilation plates; the at least side plate further comprises at least one tab extending from the main plate along the second direction, and the mounting post extends from the at least one tab along the first direction.

9. The fan module of claim 8, wherein the cover plate comprises at least one protruding piece and an arc-shaped gap defined in the at least one protruding piece; and the mounting post is engaged in the arc-shaped gap.

10. A fan frame comprising:

a blade holder having a first pair of opposite sides and a second pair of opposite sides;

a pair of ventilation plates respectively attached to the first pair of opposite sides of the blade holder along a first direction, each of the pair of ventilation plates comprising a pair of opposite beams and a pair of securing blocks formed at the pair of opposite beams;

a pair of side plates respectively attached to the second pair of opposite sides of the blade holder along a second direction substantially perpendicular to the first direction, and located between the pair of ventilation plates, the at least one side plate having a mounting post;

a pair of mounting slots respectively defined in each of the pair of side plates and respectively engaged with the pair of securing blocks, the pair of mounting slots securing the pair of ventilation plates and the pair of side plates to the blade holder;

a cover plate attached to the blade holder along a third direction different from both the first direction and second direction; wherein the cover plate is engaged with the mounting post, thereby securing the cover plate to the blade holder.

11. The fan frame of claim 10, further comprising a plurality of securing members, wherein the blade holder comprises a pair of planar frames, one of the pair of planar frames is at an air outlet of the blade holder, and another one of the pair of planar frames is at an air inlet of the blade holder, at least one mounting hole is defined in each of the pair of planar frames, at least one securing hole is defined in each of the pair of ventilation plates, and at least one of the securing members extends through the at least one securing hole and the at least one mounting hole to attach each of the pair of ventilation plates to the blade holder.

12. The fan frame of claim 11, wherein each of the securing members comprises a head, a first concave portion, a pair of resisting protrusions, a second concave portion, and a mounting end, the first concave portion is located between the head and the pair of resisting protrusions, the second concave portion is located between the pair of resisting protrusions and the mounting end; the first concave portion is engaged in the at least one securing hole, and the mounting end is engaged in the at least one mounting hole.

13. The fan module of claim 12, wherein each of the pair of resisting protrusions comprises a slanted guiding surface.

14. The fan module of claim 12, wherein a diameter of the first concave portion is less than that of the head, a diameter of the second concave portion is less than a maximum diameter of the mounting end, and the mounting end has a conical shape.

15. The fan module of claim 10, wherein a pair of notches is defined in each of the pair of opposite beams, and each of the pair of securing blocks is located in a corresponding notch.

16. The fan module of claim 15, wherein each of the pair of side plates comprises a main plate substantially perpendicular to the pair of ventilation plates and a pair of side flanges extending substantially perpendicularly from opposite sides of the main plate, and each of the pair of mounting slots comprises a wider portion defined in the main plate and a narrower portion defined in each of the pair of side flanges.

17. The fan module of claim 16, wherein the third direction is substantially perpendicular to both the first direction and the second direction.

18. The fan module of claim 17, wherein each of the side plates further comprises at least one tab extending from the main plate along the second direction, and the mounting post extends from the at least one tab along the first direction.

19. The fan module of claim 18, wherein the cover plate comprises at least one protruding piece and an arc-shaped gap defined in the at least one protruding piece; and the mounting post is engaged in the arc-shaped gap.

20. A fan frame comprising:

a blade holder having opposite sides;

a pair of ventilation plates respectively attached to the opposite sides of the blade holder along a first direction, and comprising a pair of securing blocks; each of the pair of ventilation plates comprising a vertical beam, a pair of notches defined in the vertical beam, and each of the pair of securing blocks located in a corresponding notch;

a pair of mounting slots defined in the at least one side plate and engaged with the pair of securing blocks, the pair of mounting slots securing the pair of ventilation plates and the at least one side plate to the blade holder;

at least one side plate attached to the blade holder along a second direction substantially perpendicular to the first direction, and located between the pair of ventilation plates; the at least one side plate comprising a main plate substantially perpendicular to the pair of ventilation plates and a pair of side flanges extending substantially perpendicularly from opposite sides of the main plate, each of the pair of mounting slots comprising a wider portion defined in the main plate and a narrower portion defined in each of the pair of side flanges; the at least side plate further comprising at least one tab extending from the main plate along the second direction, and a mounting post extending from the at least one tab along the first direction; and a cover plate attached to the blade holder along a third direction substantially perpendicular to both the first direction and the second direction; wherein the cover plate is engaged with the mounting post.

* * * * *